US005573593A

United States Patent [19]

Sutton

[11] Patent Number: 5,573,593

[45] Date of Patent: Nov. 12, 1996

[54] COATING APPARATUS FOR SELECTIVELY COATING EITHER OR BOTH SIDES OF A TRAVELING PAPER WEB

[75] Inventor: Graham W. Sutton, Chorley, England

[73] Assignee: Beloit Technologies, Inc., Wilmington, Del.

[21] Appl. No.: 373,661

[22] Filed: Jan. 17, 1995

(Under 37 CFR 1.47)

[51] Int. Cl.[6] ..... B05C 1/00

[52] U.S. Cl. ..... 118/262; 118/643; 118/58; 118/67; 118/68; 118/410

[58] Field of Search ..... 118/111, 117, 118, 118/119, 122, 126, 222, 227, 249, 255, 262, 643, 58, 67, 68, 410; 34/266, 273, 275, 631

[56] References Cited

U.S. PATENT DOCUMENTS

| | | | |
|---|---|---|---|
| 3,089,460 | 5/1963 | Mahoney et al. | 118/60 |
| 4,198,446 | 4/1980 | Goetz | 118/249 |
| 4,259,921 | 4/1981 | Wallsten | 118/206 |
| 4,538,358 | 9/1985 | Ericsson | 34/275 |
| 4,700,658 | 10/1987 | Beisswanger et al. | 118/67 |
| 4,793,899 | 12/1988 | Skaugen | 162/360.3 |
| 4,912,712 | 3/1990 | Dreher . | |
| 4,936,025 | 6/1990 | Heikkilä | 34/420 |
| 5,203,920 | 4/1993 | Plomer | 118/206 |
| 5,230,165 | 7/1993 | Beisswanger | 34/60 |
| 5,299,362 | 4/1994 | Baldinger | 34/273 |
| 5,303,670 | 4/1994 | Rantanen | 118/262 |
| 5,431,731 | 7/1995 | Salo et al. | 118/255 |
| 5,447,566 | 9/1995 | Loiacono | 118/58 |

*Primary Examiner*—Laura Edwards

*Attorney, Agent, or Firm*—Dirk J. Veneman; Raymond W. Campbell; Gerald A. Mathews

[57] ABSTRACT

A coating apparatus is disclosed for coating a web of paper. The apparatus includes a first and second roll having axes of rotation disposed parallel relative to each other such that the rolls define therebetween a first nip for the selective passage therethrough of the web. A backing roll has a peripheral surface which cooperates with the first roll for defining therebetween a second nip. A coater cooperates with the peripheral surface for applying coating material to the web when the web is guided by the surface and disposed between the surface and the coater. A further backing roll has a further peripheral surface which cooperates with the second roll for defining therebetween a third nip. A further coater cooperates with the further surface for applying coating material to the web when the web is guided by the further surface and disposed between the further surface and the further coater. The arrangement is such that the web in a first coating mode is guided by the surface for coating a first side of the web, and in a second mode, the web is guided by the further surface for coating a second side of the web, and in a third mode, the web is guided through the first nip for simultaneously coating the first and second sides of the web.

4 Claims, 3 Drawing Sheets

COATING APPARATUS FOR SELECTIVELY COATING EITHER OR BOTH SIDES OF A TRAVELING PAPER WEB

BACKGROUND OF THE INVENTION

1. Field of the Invention

The present invention relates to a coating apparatus for coating a web of paper.

More specifically, the present invention relates to a coating apparatus which permits the selective coating of one or both sides of a web of paper.

2. Information Disclosure Statement

Coaters have been known for applying coating material to backing rolls such that the coating material is transferred to coating rolls for simultaneously applying coating to both sides of a web.

However, in specialty mills, various grades of paper must be coated on a short run basis, and it is desirable to have a coating apparatus having the flexibility to rapidly change from coating one grade to another.

The present invention provides a coating machine with the flexibility to apply coating material simultaneously to both sides of a web by the roll method or to the first or second side of the web by a single blade coating arrangement.

Some of the advantages achieved by the aforementioned arrangement are the provision of a single tension control system. Also, with the arrangement according to the present invention, there is no requirement to make roll changes for a particular web path or coating method.

Additional advantages of the arrangement according to the present invention include:

1. Alternate pathways through the coater do not require reversible drives for the paper rolls common to alternate web runs.
2. The paper web rolls do not need to be movable in order to accommodate alternate run geometries.
3. Each of the web runs in the alternate coating modes do not require a separate dedicated tension control loop.
4. Each of the alternate web runs does not necessarily require a dedicated drying section. Rather, the drying arrangement may be usable for more than one web run.
5. The hardness of the respective rolls does not have to be changed for the handling of various web grades.

Additionally, the arrangement according to the present invention provides a coating apparatus in which the drying means is located above the coating apparatus, thereby enhancing accessibility to the coater apparatus and, particularly, permits access to the short dwell coater heads thereof.

Therefore, it is a primary objective of the present invention to provide a coating apparatus which permits alternate runs of the web therethrough for accomplishing various coating operations.

A further object of the present invention is to provide a coating apparatus having improved accessibility.

Other objects and advantages of the present invention will be readily apparent to those skilled in the art by a consideration of the detailed description contained hereinafter, taken in conjunction with the annexed drawings.

SUMMARY OF THE INVENTION

The present invention relates to a coating apparatus for coating a web of paper. The apparatus includes a first and second roll having axes of rotation disposed parallel relative to each other such that the rolls define therebetween a first nip for the selective passage therethrough of the web.

A backing roll has a peripheral surface which cooperates with the first roll for defining therebetween a second nip.

Coating means cooperate with the peripheral surface for applying coating material to the web when the web is guided by the surface and disposed between the surface and the coating means.

A further backing roll has a further peripheral surface which cooperates with the second roll for defining therebetween a third nip.

A further coating means cooperates with the further surface for applying coating material to the web when the web is guided by the further surface and disposed between the further surface and the further coating means. The arrangement is such that the web, in a first coating mode thereof, is guided by the surface for coating a first side of the web. In a second mode thereof, the web is guided by the further surface for coating a second side of the web. In a third mode of the coating apparatus, the web is guided through the first nip for simultaneously coating the first and second sides of the web.

Many variations and modifications of the present invention will be readily apparent to those skilled in the art by a consideration of the detailed description contained hereinafter, taken in conjunction with the annexed drawings. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
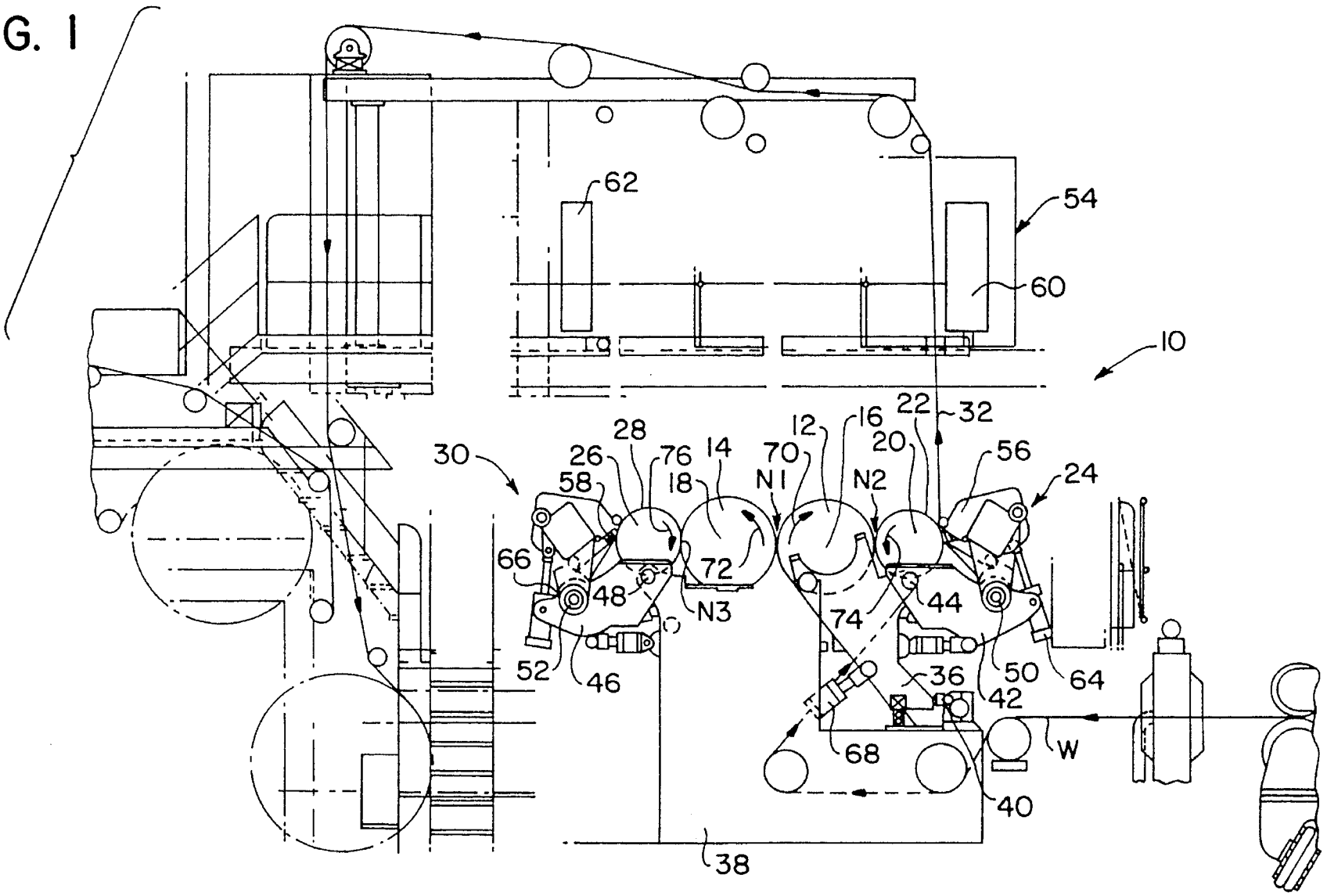
FIG. 1 is a side-elevational view of a coating apparatus according to the present invention operating in a first mode thereof.
Figure 2:
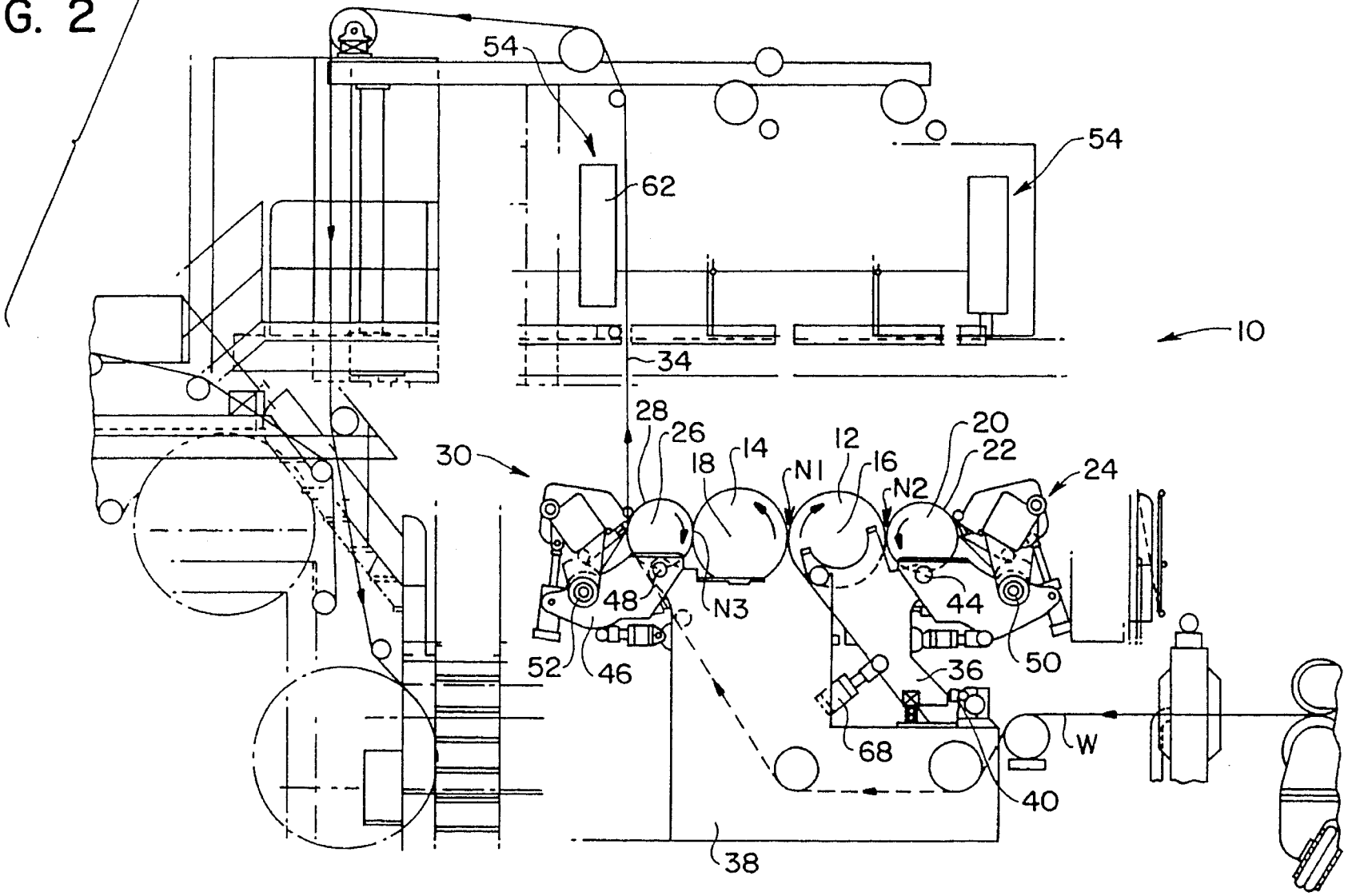
FIG. 2 is a side-elevational view of the apparatus shown in FIG. 1, but with the coating apparatus operating in a second mode thereof.
Figure 3:
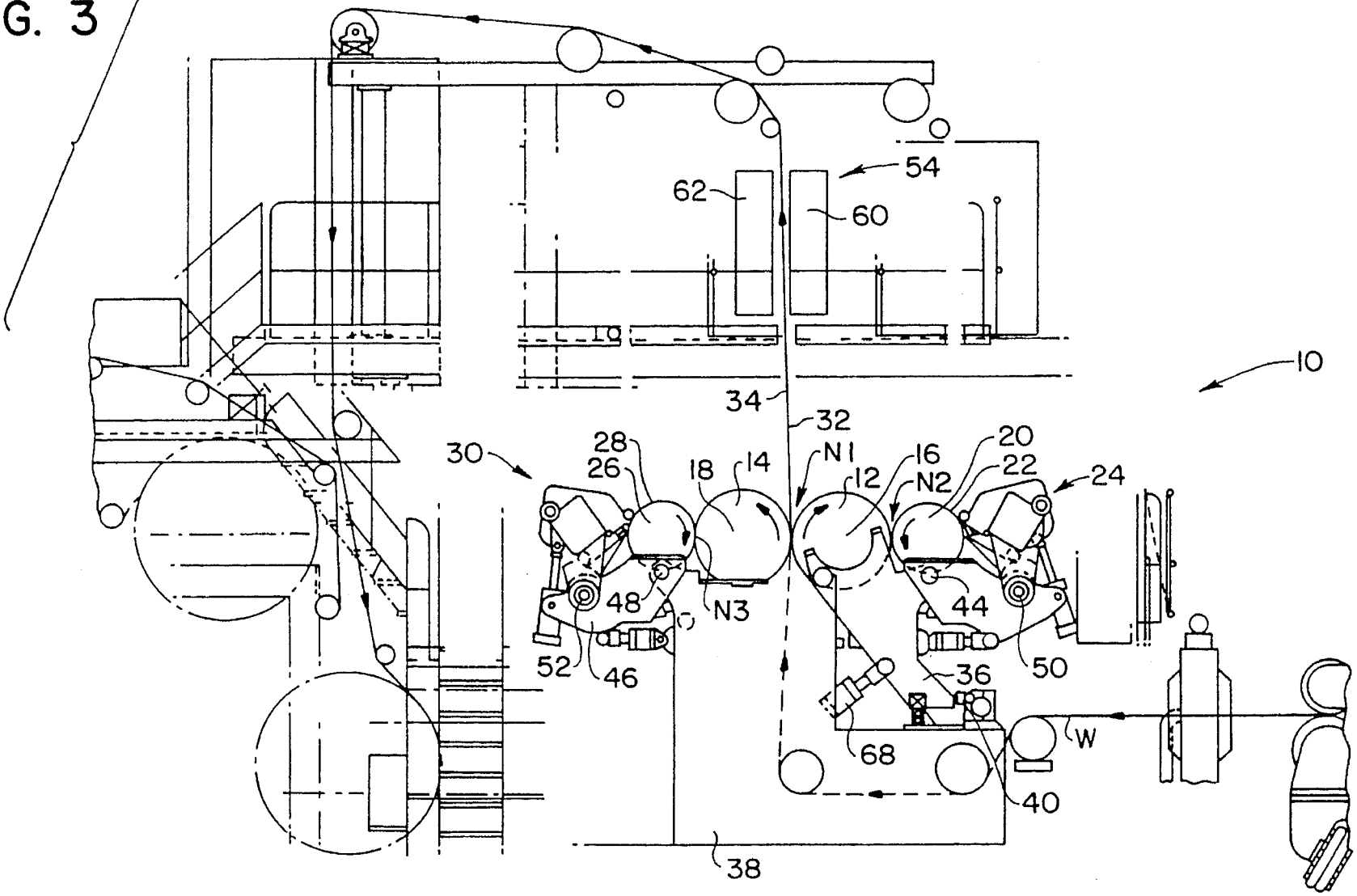
FIG. 3 is a side-elevational view similar to that shown in FIG. 1, but showing the coating apparatus operating in a third mode thereof.

FIGS. 1, 2 and 3 show, respectively, a coating apparatus according to the present invention operating in a first, second and third mode thereof.

More specifically, the present invention relates to a coating apparatus, generally designated 10, for coating a web of paper W. The apparatus 10 includes a first and second roll 12 and 14, respectively, having axes of rotation 16 and 18 disposed parallel relative to each other such that the rolls 12 and 14 define therebetween a first nip N1 for the selective passage therethrough of the web W.

A backing roll 20 has a peripheral surface 22 which cooperates with the first roll 12 for defining therebetween a second nip N2.

Coating means, generally designated 24, cooperate with the peripheral surface 22 for applying coating material to the web W when the web is guided by the surface 22 and disposed between the surface 22 and the coating means 24.

A further backing roll 26 having a further peripheral surface 28 cooperates with the second roll 14 for defining therebetween a third nip N3.

Further coating means, generally designated 30, cooperate with the further surface 28 for applying coating material to the web W when the web W is guided by the further surface 28 and disposed between the further surface 28 and the further coating means 30, as shown in FIG. 2.

The arrangement is such that the web W, in a first coating mode thereof, as shown in FIG. 1, is guided by the surface 22 for coating a first side 32 of the web W.

In a second mode of the coating apparatus 10, as shown in FIG. 2, the web W is guided by the further surface 28 for coating a second side 34 of the web W.

In a third mode of the coating apparatus 10, as shown in FIG. 3, the web W is guided through the first nip N1 for simultaneously coating the first and second sides 32 and 34, respectively, of the web W.

As seen in FIGS. 1 to 3, the web W travels upwardly during coating thereof in the first, second and third modes thereof.

As shown in FIGS. 1 to 3, the coating apparatus 10 further includes a frame 36 for rotatably supporting the first roll 12.

A further frame 38 rotatably supports the second roll 14, and the frame 36 is pivotally secured at 40 to the further frame 38 for permitting selective movement of the first roll 12 relative to the second roll 14 for facilitating threading of the web W for operation of the apparatus 10 in the third mode, as shown in FIG. 3.

The coating apparatus 10 also includes a sub-frame 42 for rotatably supporting the backing roll 20. The sub-frame 42 is pivotally secured at 44 to the frame 36 for selectively permitting opening of the second nip N2.

The coating apparatus 10 also includes a further sub-frame 46 for rotatably supporting the further backing roll 26. The further sub-frame 46 is pivotally secured at 48 to the further frame 38 for permitting selective opening of the third nip N3.

As shown in FIGS. 1 to 3, the coating means 24 is pivotally secured at 50 to the sub-frame 42 for permitting threading of the web W when the coating apparatus 10 is operated in the first mode, as shown in FIG. 1.

The further coating means 30 is pivotally secured at 52 to the further sub-frame 46 for permitting selective threading of the web W when the coating apparatus 10 is operated in the second mode, as shown in FIG. 2.

As shown in FIGS. 1 to 3, the coating apparatus 10 also includes heating means, generally designated 54, disposed above the first and second rolls 12 and 14 for permitting drying of the web W when the coating apparatus 10 is in any of the operating modes as shown in FIGS. 1 to 3.

The coating means 24 is a short dwell coater 56 for applying coating material to the first side 32 of the web W when the coating apparatus 10 is operating in the first mode, as shown in FIG. 1, and for coating the peripheral surface 22 when the coating apparatus 10 is operated in the third mode thereof, as shown in FIG. 3.

The further coating means 30 is a further short dwell coater 58 for applying a coating material to the second side 34 of the web W when the coating apparatus 10 is operated in the second mode thereof, as shown in FIG. 2, and for coating the further surface 28 when the coating apparatus 10 is operated in the third mode thereof, as shown in FIG. 3.

The coating material in the third mode, as shown in FIG. 3, is transferred respectively from the surface 22 and the further surface 28 onto the first and second rolls 12 and 14, respectively, so that the coating material is transferred onto the first and second sides 32 and 34, respectively, of the web W extending through the first nip N1.

The heating means, generally designated 54, includes a first heater 60 movably disposed adjacent to the first side 32 of the web W when the coater apparatus 10 is operated in the first mode, as shown in FIG. 1.

A second heater 62 is movably disposed adjacent to the second side 34 of the web W when the coater apparatus 10 is operated in the second mode thereof, as shown in FIG. 2.

The first and the second heaters 60 and 62, respectively, are movable to the first and second sides 32 and 34 of the web W when the coater apparatus 10 is operated in the third mode thereof, as shown in FIG. 3.

The heating means may include either infrared heaters or air flotation dryers.

In operation of the coating apparatus according to the present invention, actuating means 64 are actuated to move the short dwell coater 24 away from the backing roll 20 to permit threading of the web between the short dwell coater 56 and the backing roll 20. Subsequently, the actuating means 64 moves the coater 56 back towards the web, and the coating operation of the first side 32 of the web is commenced, as shown in FIG. 1.

If the opposite side, that is the second side 34 of the web, is to be coated, a further actuating means 66 is operated to pivot the short dwell coater 58 away from the further backing roll 26 for permitting the web to be rethreaded between the further backing roll 26 and the further short dwell coater 58, as shown in FIG. 2. Additionally, the second side 34 of the web is dried by the second heater When both sides of the web are to be simultaneously coated, actuator 68 is actuated to swing the first roll 12 away from the second roll 14 for permitting threading of the web through the first nip N1. Subsequently, the short dwell coaters 56 and 58 coat the surfaces 22 and 28 so that coating material is transferred from the surfaces 22 and 28 onto the first and second rolls 12 and 14 such that coating material is applied to both sides 32,34 of the web simultaneously, as shown in FIG. 3.

As shown in FIG. 3, the first and second rolls 12,14 counter-rotate, as shown by arrows 70 and 72, so that the web is permitted to move upwardly therebetween.

Additionally, the backing and further backing rolls 20 and 26 counter-rotate, as shown by arrows 74 and 76, such rotation being in cooperation with the respective first and second roll 12,14.

The first heater 60 permits drying of the first side 32 of the web, whereas the second heater 62 dries the second side 34 of the web. However, the first and second heaters 60 and 62 are movable towards each other for drying the opposite sides of the web when the coating apparatus 10 is operated in the third mode thereof, as shown in FIG. 3.

It will be understood by those skilled in the art that the heaters may be infrared heaters or air flotation heaters, or any type of heater.

Also, it will be appreciated by those skilled in the art that a single heater could be used for heating the coated web and drying the same when the apparatus is used in any of the coating modes.

The present invention provides a relatively simple layout for a coating apparatus permitting flexibility of coating operations and a rapid change from one mode of operation to another.

What is claimed is:

1. A coating apparatus for selectively coating either, or both, sides of a traveling web of paper, said apparatus comprising:

a frame means;

a first and second roll mounted in the frame means, the first and second rolls having axes of rotation disposed parallel relative to each other such that said rolls defined therebetween a first nip for selective passage therethrough of the web;

a backing roll mounted in the frame means, the backing roll having a peripheral surface which cooperates with said first roll for defining therebetween a second nip;

coating means mounted in the frame means, the coating means cooperating with said peripheral surface for applying coating material to the web when the web is selectively guided by said surface and disposed between said surface and said coating means;

a further backing roll mounted in the frame means, the further backing roll having a further peripheral surface which cooperates with said second roll for defining therebetween a third nip; and further coating means mounted in the frame means, the further coating means cooperating with said further peripheral surface for applying coating material to the web when the web is selectively guided by said further surface and disposed between said further peripheral surface and said further coating means;

the coating means and further coating means cooperating with the said backing roll and further backing roll, respectively, when the web is selectively passed through the first nip, such that the coating is applied from the backing roll and the further backing roll to the first and second rolls for coating both sides of the web passing through the first nip;

the frame means being so constructed and arranged that the first roll is selectively moveable relative to the second roll, the backing roll is selectively moveable relative to the first roll, the further backing roll is selectively moveable relative to the second roll, and the coating means and further coating means are selective moveable relative to the backing roll and the further backing roll, respectively, such that the web selectively in a first coating mode is guided by said surface for coating a first side of the web, and selectively in a second coating mode, the web is guided by said further surface for coating a second side of the web, and selectively in a third coating mode, the web is guided through said first nip for simultaneously coating said first and second sides of the web wherein the coating apparatus is constructed and arranged so as to permit the web to travel upwardly in any of the three modes to be coated on either of its sides, or both sides, thereof in the first, second or third modes; and further including heating means disposed above said first and second rolls, and moveable to be selectively associated with a respective one of the three modes, for permitting drying of the web when the coating apparatus is in any of said three modes.

2. A coating apparatus as set forth in claim 1, the frame means further including:

a sub-frame for rotatably supporting said backing roll;

said sub-frame being pivotally secured to said frame for selectively permitting opening of said second nip.

3. A coating apparatus as set forth in claim 2, the frame means further including:

a further sub-frame for rotatably supporting said further backing roll;

said further sub-frame being pivotally secured to said further frame for permitting selective opening of said third nip.

4. A coating apparatus as set forth in claim 1, wherein said heating means includes:

a first heater movably disposed adjacent to said first side of the web when the coating apparatus is operated in said first mode;

a second heater movably disposed adjacent to said second side of the web when the coating apparatus is operated in said second mode;

said first and second heaters being movable to said first and second sides of the web when the coating apparatus is operated in said third mode.

* * * * *